US010575687B1

(12) United States Patent
Ehrenberg

(10) Patent No.: US 10,575,687 B1
(45) Date of Patent: Mar. 3, 2020

(54) SANITARY CHAIR

(71) Applicant: Vince Ehrenberg, Chicago, IL (US)

(72) Inventor: Vince Ehrenberg, Chicago, IL (US)

(73) Assignee: Vince Ehrenberg, Chicago, IL (US)

( * ) Notice: Subject to any disclaimer, the term of this patent is extended or adjusted under 35 U.S.C. 154(b) by 31 days.

(21) Appl. No.: 15/620,907

(22) Filed: Jun. 13, 2017

(51) Int. Cl.
*A47K 11/04* (2006.01)
*A61G 5/02* (2006.01)
*A61G 7/02* (2006.01)

(52) U.S. Cl.
CPC ..... *A47K 11/04* (2013.01); *A61G 5/022* (2013.01); *A61G 7/02* (2013.01)

(58) Field of Classification Search
CPC .. A47K 11/04; A47C 7/50; A47C 7/54; A47C 7/541; A47C 7/543
USPC ..... 4/238
See application file for complete search history.

(56) References Cited

U.S. PATENT DOCUMENTS

| | | | | |
|---|---|---|---|---|
| 3,512,187 | A | 5/1970 | Thomas | |
| D360,172 | S | 7/1995 | Francke | |
| 5,517,704 | A | 5/1996 | Dagostino | |
| D389,099 | S | 1/1998 | McKay | |
| 6,039,403 | A * | 3/2000 | Hargroder | A47K 3/122 297/440.16 |
| 6,105,183 | A * | 8/2000 | Bly | A47K 3/122 297/94 |
| 6,334,225 | B1 * | 1/2002 | Brinkmann | A47K 3/122 4/560.1 |
| 7,690,055 | B2 | 4/2010 | Hammer | |
| 8,517,414 | B2 | 8/2013 | Goldstein | |
| 2007/0101487 | A1 | 5/2007 | Major | |
| 2011/0198902 | A1 * | 8/2011 | Renbarger | A47C 9/00 297/219.1 |
| 2015/0351591 | A1 * | 12/2015 | Wechter | A61G 7/1003 4/560.1 |

* cited by examiner

*Primary Examiner* — Lauren A Crane
(74) *Attorney, Agent, or Firm* — Beem Patent Law Firm

(57) ABSTRACT

The sanitary chair forms a seat that is a configured for use in a shower and with a commode. A patient sits on a horizontal surface formed by the sanitary chair. One dimension of the horizontal surface is adjustable. The sanitary chair comprises a plurality of legs, a base structure, a rail, a seat cushion, a folding cushion, and a back rest. The base structure forms the horizontal seating surface of the sanitary chair. The plurality of legs raise the base structure above the supporting surface. The seat cushion and the folding cushion forms the horizontal seating surface of the supporting chair. The back rest is a vertically oriented structure that supports the back of the patient. The rail, the seating cushion, the folding cushion, and the back rest are attached to the base structure.

8 Claims, 8 Drawing Sheets

SANITARY CHAIR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of medical and veterinary science including patient accommodations, more specifically, a part, detail or accessory of a chair.

SUMMARY OF INVENTION

The sanitary chair is a medical device. The sanitary chair provides mobility assistance to a patient. The sanitary chair is a configured for use in a shower. The sanitary chair is configured for use with a commode. The sanitary chair forms a seat. The seat is formed with a coaxial aperture that is configured for use with the commode. The coaxial aperture is a negative space. The negative space of the coaxial aperture that forms a rectangular prism. The patient sits on a horizontal surface formed by the sanitary chair. One dimension of the horizontal surface is adjustable for seating purposes. The sanitary chair is placed within a shower to allow the patient to sit on the sanitary chair for bathing purposes. The sanitary chair may be placed over the commode such that the coaxial aperture is centered over the commode in a manner that allows the patient to sit on the sanitary chair for the biological purposes of evacuation and elimination. The sanitary chair comprises a plurality of legs, a base structure, a rail, a seat cushion, a folding cushion, and a back rest. The base structure forms the horizontal seating surface of the sanitary chair. The plurality of legs raise the base structure above the supporting surface. The seat cushion and the folding cushion forms the horizontal seating surface of the supporting chair. The back rest is a vertically oriented structure that supports the back of the patient. The rail, the seating cushion, the folding cushion, and the back rest are attached to the base structure.

These together with additional objects, features and advantages of the sanitary chair will be readily apparent to those of ordinary skill in the art upon reading the following detailed description of the presently preferred, but nonetheless illustrative, embodiments when taken in conjunction with the accompanying drawings.

In this respect, before explaining the current embodiments of the sanitary chair in detail, it is to be understood that the sanitary chair is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the sanitary chair.

It is therefore important that the claims be regarded as including such equivalent construction insofar as they do not depart from the spirit and scope of the sanitary chair. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
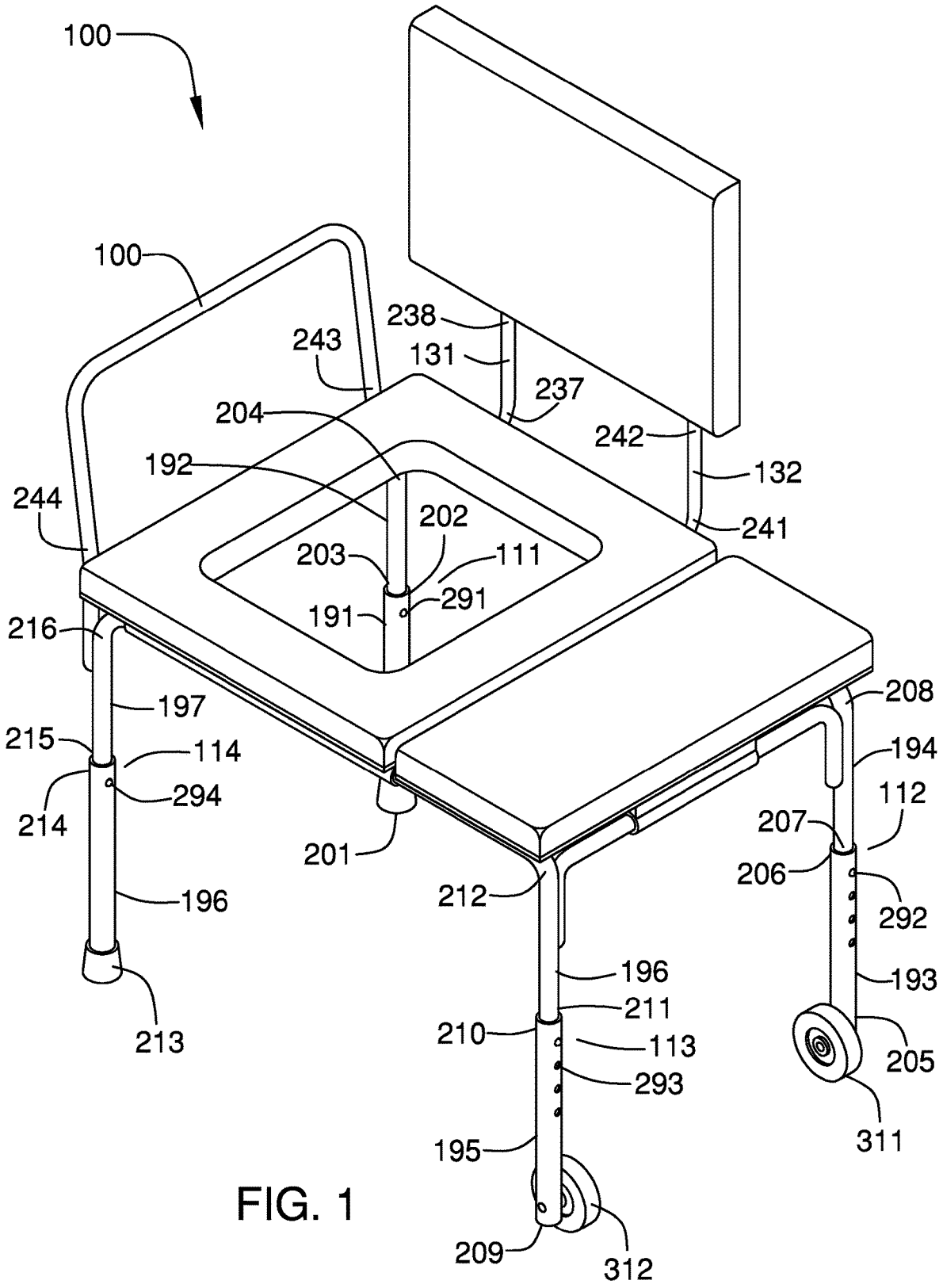
FIG. 1 is a perspective view of an embodiment of the disclosure.
Figure 2:
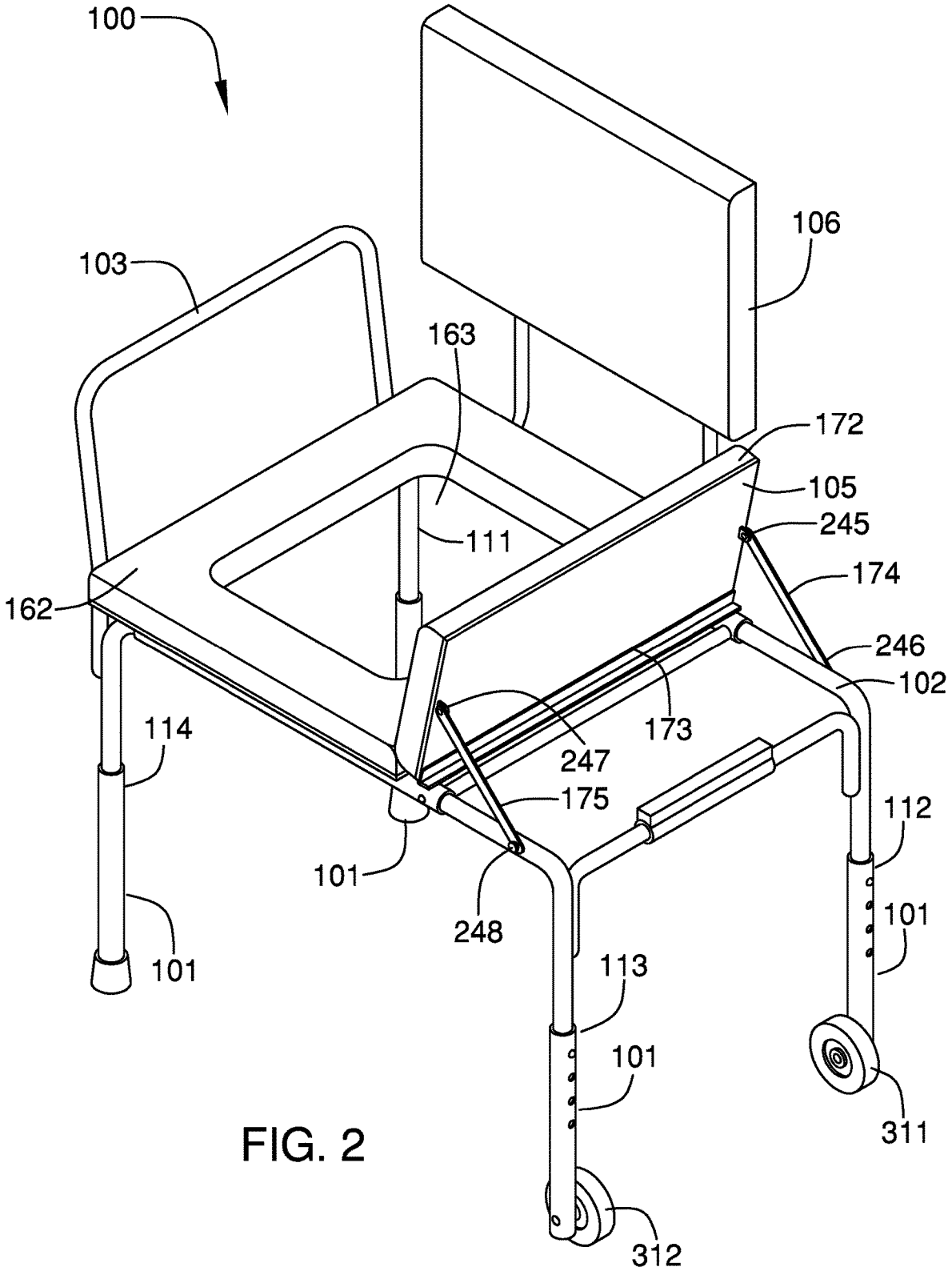
FIG. 2 is a perspective view of an embodiment of the disclosure.
Figure 3:
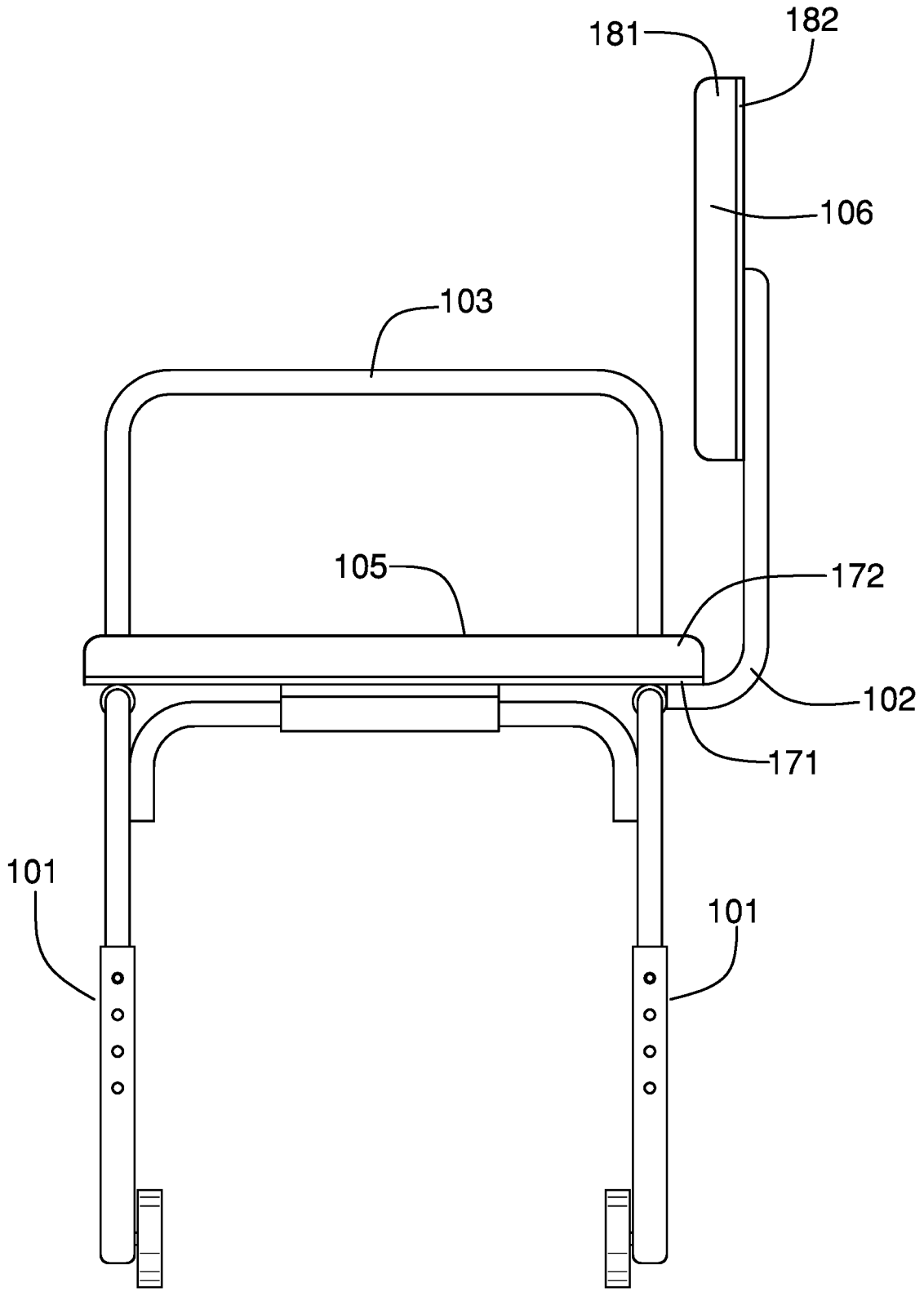
FIG. 3 is a side view of an embodiment of the disclosure.
Figure 4:
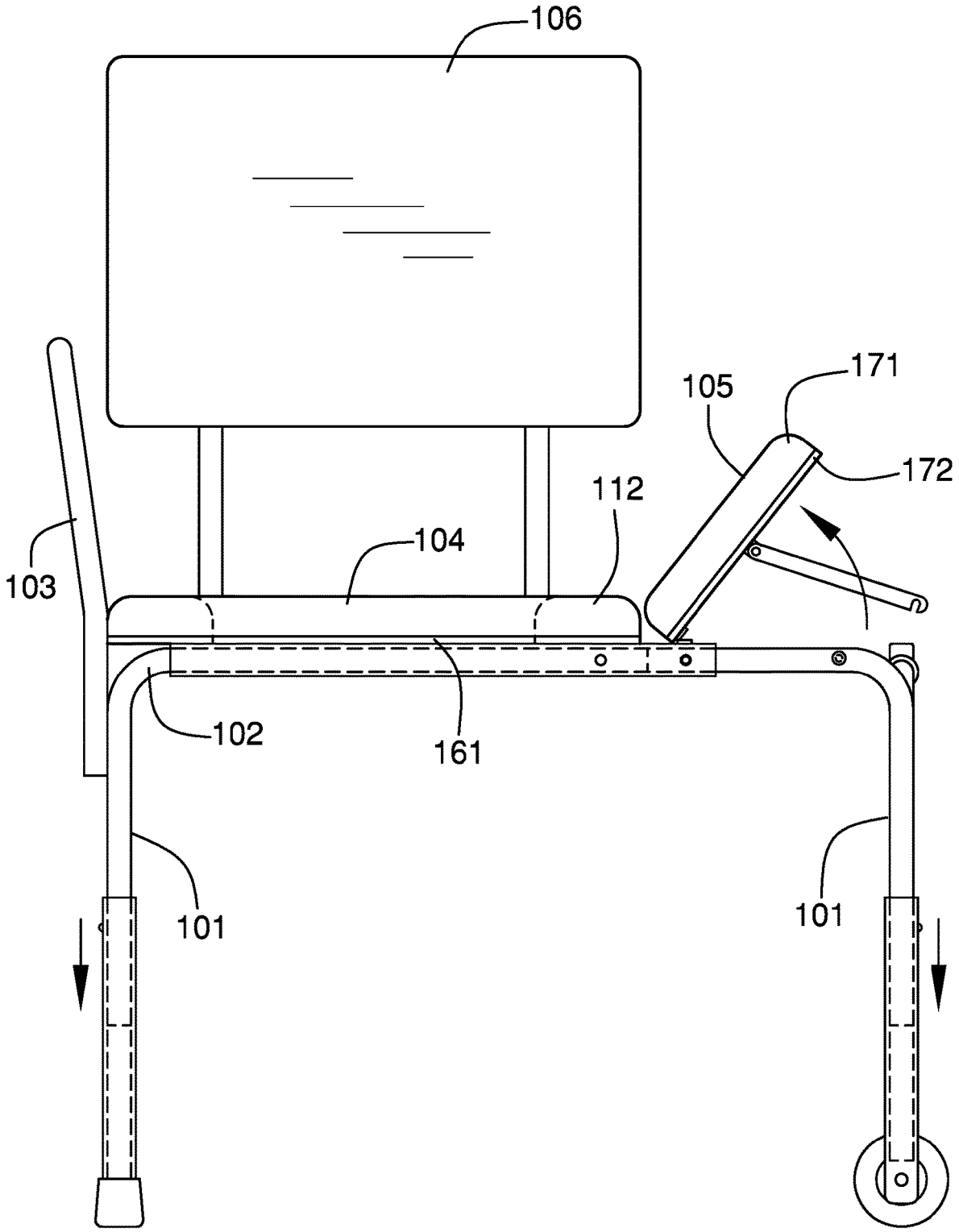
FIG. 4 a front view of an embodiment of the disclosure.
Figure 5:
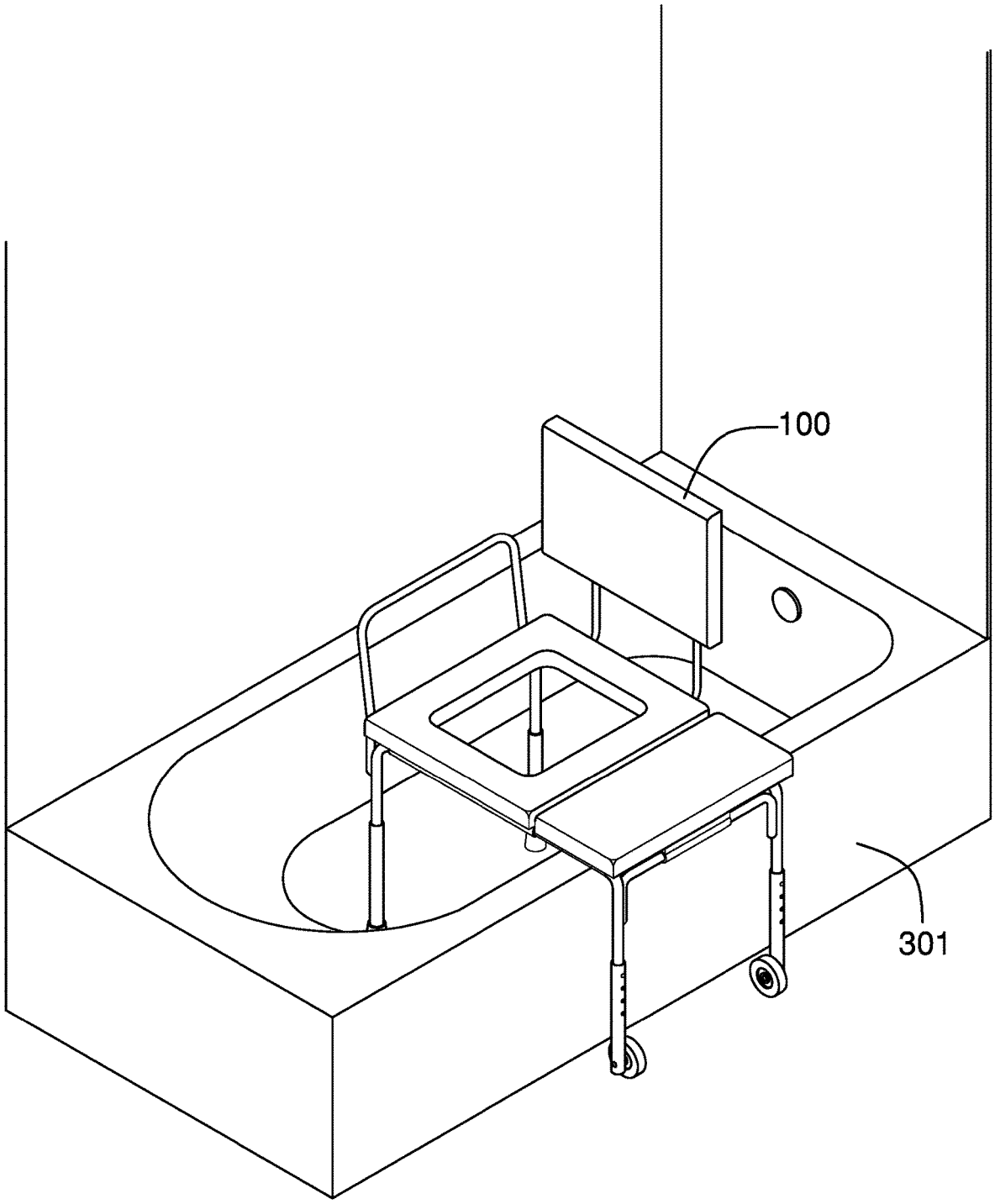
FIG. 5 is an in use view of an embodiment of the disclosure.
Figure 6:
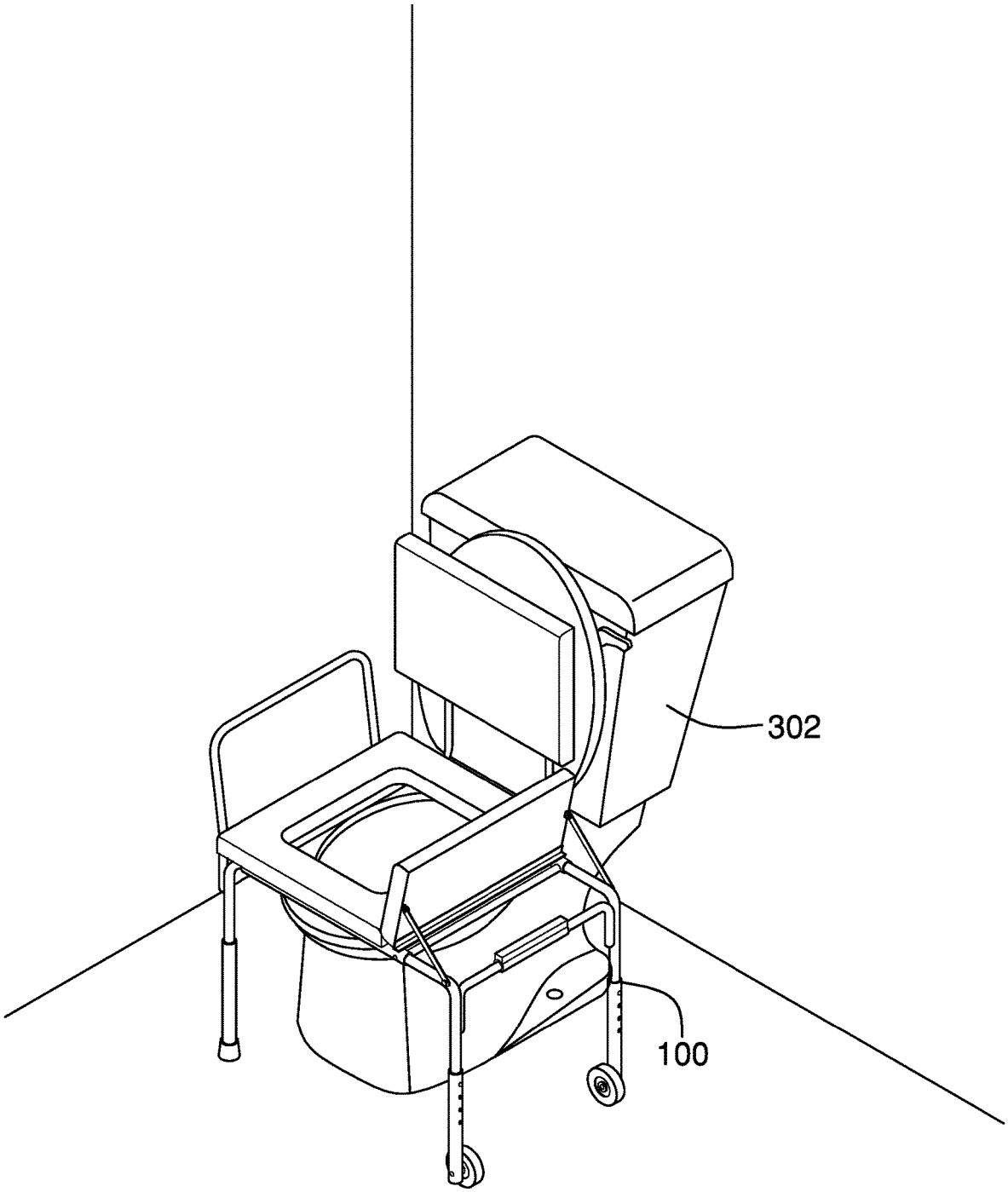
FIG. 6 is an in use view of an embodiment of the disclosure.
Figure 7:
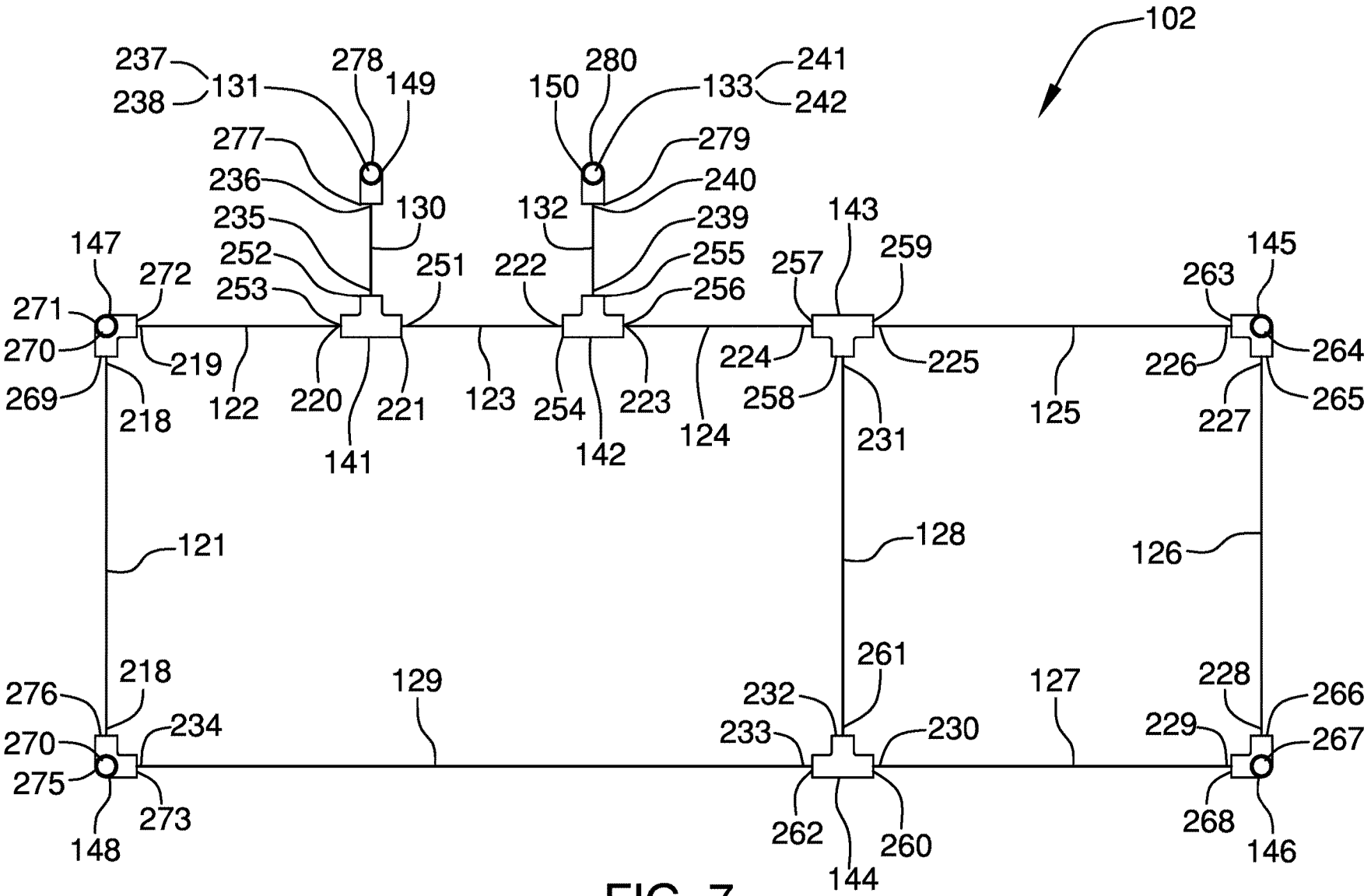
FIG. 7 is a detail view of an embodiment of the disclosure.
Figure 8:
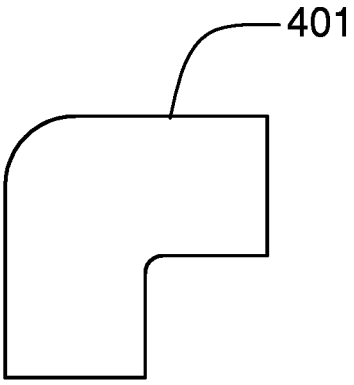
FIG. 8 is a detail view of an embodiment of the disclosure.
Figure 9:
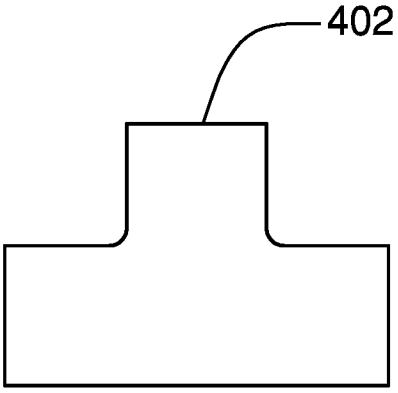
FIG. 9 is a detail view of an embodiment of the disclosure.
Figure 11:
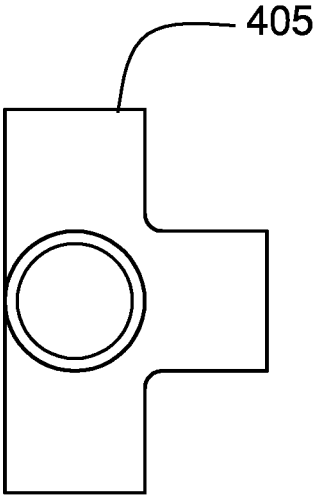
FIG. 11 is a detail view of an embodiment of the disclosure.
Figure 10:
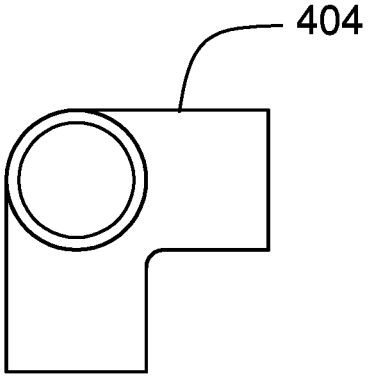
FIG. 10 is a detail view of an embodiment of the disclosure.

Detailed reference will now be made to one or more potential embodiments of the disclosure, which are illustrated in FIGS. 1 through 11.

The sanitary chair 100 (hereinafter invention) is a medical device. The invention 100 provides mobility assistance to a patient. The invention 100 is a configured for use in a shower 301. The shower 301 refers to an externally provided bathing structure that is used by the patient. The invention 100 is configured for use with a commode 302. The commode 302 refers to an externally provided sanitary structure that is used by the patient. The invention 100 forms a chair. The chair is formed with a coaxial aperture 163 that is configured for use with the commode 302. The coaxial aperture 163 is a negative space. The negative space of the coaxial aperture 163 forms a rectangular prism. The patient sits on a horizontal surface formed by the invention 100. One dimension of the horizontal surface is adjustable for seating purposes.

The invention 100 is placed within a shower 301 to allow the patient to sit on the invention 100 for bathing purposes. The invention 100 may be placed over the commode 302 such that the coaxial aperture 163 is centered over the commode 302 in a manner that allows the patient to sit on the invention 100 for the biological purposes of evacuation and elimination. The invention 100 comprises a plurality of legs 101, a base structure 102, a rail 103, a seating cushion 104, a folding cushion 105, and a back rest 106. The base structure 102 forms the horizontal seating surface of the invention 100. The plurality of legs 101 raise the base structure 102 above the supporting surface. The seating cushion 104 and the folding cushion 105 forms the horizontal seating surface of the supporting surface. The back rest 106 is a vertically oriented structure that supports the back of the patient. The rail 103, the seating cushion 104, the folding cushion 105, and the back rest 106 are attached to the base structure 102.

The plurality of legs 101 are used to raise the base structure 102 above the supporting surface upon which the invention 100 is placed. The plurality of legs 101 are not interconnected with cross braces but attach independently to the base structure 102. The plurality of legs 101 do not use cross braces for the purpose of allowing the invention 100 to: 1) be placed directly over a commode 302; and, 2) allow the invention 100 to be placed directly over the edge of a bathtub or a shower 301. The plurality of legs 101 comprises a first telescopic leg 111, a second telescopic leg 112, a third telescopic leg 113, and a fourth telescopic leg 114.

The first telescopic leg 111 further comprises a first arm 191, a second arm 192 and a first detent 291. The first detent 291 connects the second arm 192 to the first arm 191. The first arm 191 is a hollow first structure that is further defined with an inner dimension. The second arm 192 is a hollow second structure that is further defined with an outer dimension. The outer dimension of the second arm 192 is less than the inner dimension of the first arm 191 such that the second arm 192 can be inserted into the first arm 191 in a telescopic manner. This telescopic arrangement of the telescopic leg 191 allows the length of the telescopic leg 191 to be adjusted by adjusting the relative position of the second arm 192 within the first arm 191. The position of the second arm 192 relative to the first arm 191 is held in position using the first detent 291. The first detent 291 is a mechanical device that connects and secures the first arm 191 to the second arm 192. The first detent 291 is selected from the group consisting of a cotter pin, a G snap collar, a cam lock collar, a threaded clutch, a split collar lock, or a spring-loaded ball lock. In the first potential embodiment of the disclosure, the first detent 291 is a spring-loaded ball lock.

The second telescopic leg 112 further comprises a third arm 193, a fourth arm 194, a second detent 292, and a first wheel 311. The second detent 292 connects the fourth arm 194 to the third arm 193. The third arm 193 is a hollow first structure that is further defined with an inner dimension. The fourth arm 194 is a hollow second structure that is further defined with an outer dimension. The outer dimension of the fourth arm 194 is less than the inner dimension of the third arm 193 such that the fourth arm 194 can be inserted into the third arm 193 in a telescopic manner. This telescopic arrangement of the telescopic leg 191 allows the length of the telescopic leg 191 to be adjusted by adjusting the relative position of the fourth arm 194 within the third arm 193. The position of the fourth arm 194 relative to the third arm 193 is held in position using the second detent 292. The second detent 292 is a mechanical device that connects and secures the third arm 193 to the fourth arm 194. The second detent 292 is selected from the group consisting of a cotter pin, a G snap collar, a cam lock collar, a threaded clutch, a split collar lock, or a spring-loaded ball lock. In the first potential embodiment of the disclosure, the second detent 292 is a spring-loaded ball lock. The first wheel 311 is attached to the fifth end 205 of the third arm 193.

The third telescopic leg 113 further comprises a fifth arm 195, a sixth arm 196, a third detent 293, and a second wheel 312. The third detent 293 connects the sixth arm 196 to the fifth arm 195. The fifth arm 195 is a hollow first structure that is further defined with an inner dimension. The sixth arm 196 is a hollow second structure that is further defined with an outer dimension. The outer dimension of the sixth arm 196 is less than the inner dimension of the fifth arm 195 such that the sixth arm 196 can be inserted into the fifth arm 195 in a telescopic manner. This telescopic arrangement of the telescopic leg 191 allows the length of the telescopic leg 191 to be adjusted by adjusting the relative position of the sixth arm 196 within the fifth arm 195. The position of the sixth arm 196 relative to the fifth arm 195 is held in position using the third detent 293. The third detent 293 is a mechanical device that connects and secures the fifth arm 195 to the sixth arm 196. The third detent 293 is selected from the group consisting of a cotter pin, a G snap collar, a cam lock collar, a threaded clutch, a split collar lock, or a spring-loaded ball lock. In the first potential embodiment of the disclosure, the third detent 293 is a spring-loaded ball lock. The second wheel 312 is attached to the ninth end 209 of the fifth arm 195.

The fourth telescopic leg 114 further comprises a seventh arm 197, an eighth arm 198 and a fourth detent 294. The fourth detent 294 connects the eighth arm 198 to the seventh arm 197. The seventh arm 197 is a hollow first structure that is further defined with an inner dimension. The eighth arm 198 is a hollow second structure that is further defined with an outer dimension. The outer dimension of the eighth arm 198 is less than the inner dimension of the seventh arm 197 such that the eighth arm 198 can be inserted into the seventh arm 197 in a telescopic manner. This telescopic arrangement of the telescopic leg 191 allows the length of the telescopic leg 191 to be adjusted by adjusting the relative position of the eighth arm 198 within the seventh arm 197. The position of the eighth arm 198 relative to the seventh arm 197 is held in position using the fourth detent 294. The fourth detent 294 is a mechanical device that connects and secures the seventh arm 197 to the eighth arm 198. The fourth detent 294 is selected from the group consisting of a cotter pin, a G snap collar, a cam lock collar, a threaded clutch, a split collar lock, or a spring-loaded ball lock. In the first potential embodiment of the disclosure, the fourth detent 294 is a spring-loaded ball lock.

The first arm 191 is a commercially available hollow cylindrical pipe. The second arm 192 is a commercially available hollow cylindrical pipe. The third arm 193 is a commercially available hollow cylindrical pipe. The fourth arm 194 is a commercially available hollow cylindrical pipe. The fifth arm 195 is a commercially available hollow cylindrical pipe. The sixth arm 196 is a commercially available hollow cylindrical pipe. The seventh arm 197 is a commercially available hollow cylindrical pipe. The eighth arm 198 is a commercially available hollow cylindrical pipe.

The first wheel 311 is a commercially available wheel. The second wheel 312 is a commercially available wheel.

The first arm 191 is further defined with a first end 201 and a second end 202. The second arm 192 is further defined with a third end 203 and a fourth end 204. The third arm 193 is further defined with a fifth end 205 and a sixth end 206. The fourth arm 194 is further defined with a seventh end 207 and an eighth end 208. The fifth arm 195 is further defined with a ninth end 209 and a tenth end 210. The sixth arm 196 is further defined with an eleventh end 211 and a twelfth end 212. The seventh arm 197 is further defined with a thirteenth end 213 and a fourteenth end 214. The eighth arm 198 is further defined with a fifteenth end 215 and a sixteenth end 216.

The base structure 102 combines with the plurality of legs 101 to form a scaffolding that forms a horizontal surface. The horizontal surface provides a raised location where the patient may sit. The base structure 102 is a rectangular structure that: 1) is raised above the supporting surface to a convenient seating position; and 2) to which the seating cushion 104 and the folding cushion 105 are attached to form the horizontal seating surface.

The base structure 102 comprises a first shaft 121, a second shaft 122, a third shaft 123, a fourth shaft 124, a fifth shaft 125, a third shaft 123, a seventh shaft 127, an eighth shaft 128, a ninth shaft 129, a tenth shaft 130, an eleventh shaft 131, a twelfth shaft 132, and a thirteenth shaft 133.

The first shaft 121 is a commercially available hollow cylindrical pipe. The second shaft 122 is a commercially available hollow cylindrical pipe. The third shaft 123 is a commercially available hollow cylindrical pipe. The fourth shaft 124 is a commercially available hollow cylindrical pipe. The fifth shaft 125 is a commercially available hollow cylindrical pipe. The sixth shaft 126 is a commercially available hollow cylindrical pipe. The seventh shaft 127 is a commercially available hollow cylindrical pipe. The eighth shaft 128 is a commercially available hollow cylindrical pipe. The ninth shaft 129 is a commercially available hollow cylindrical pipe. The tenth shaft 130 is a commercially available hollow cylindrical pipe. The eleventh shaft 131 is a commercially available hollow cylindrical pipe. The twelfth shaft 132 is a commercially available hollow cylindrical pipe. The thirteenth shaft 133 is a commercially available hollow cylindrical pipe.

The first shaft 121 is further defined with a seventeenth end 217 and an eighteenth end 218. The second shaft 122 is further defined with a nineteenth end 219 and a twentieth end 220. The third shaft 123 is further defined with a twenty first end 221 and a twenty second end 222. The fourth shaft 124 is further defined with a twenty third end 223 and a twenty fourth end 224. The fifth shaft 125 is further defined with a twenty fifth end 225 and a twenty sixth end 226. The sixth shaft 126 is further defined with a twenty seventh end 227 and a twenty eighth end 228. The seventh shaft 127 is further defined with a twenty ninth end 229 and a thirtieth end 230.

The eighth shaft 128 is further defined with a thirty first end 231 and a thirty second end 232. The ninth shaft 129 is further defined with a thirty third end 233 and a thirty fourth end 234. The tenth shaft 130 is further defined with a thirty fifth end 235 and a thirty sixth end 236. The eleventh shaft 131 is further defined with a thirty seventh end 237 and a thirty eighth end 238. The twelfth shaft 132 is further defined with a thirty ninth end 239 and a fortieth end 240. The thirteenth shaft 133 is further defined with a forty first end 241 and a forty second end 242.

The base structure 102 further comprises a first tee connector 141, a second tee connector 142, a third tee connector 143, and a fourth tee connector 144. The first tee connector 141 is a commercially available tee connector 402. The second tee connector 142 is a commercially available tee connector 402. The third tee connector 143 is a commercially available tee connector 402. The fourth tee connector 144 is a commercially available tee connector 402. The first tee connector 141 is further defined with a first port 251, a second port 252, and a third port 253. The second tee connector 142 is further defined with a fourth port 254, a fifth port 255, and a sixth port 256. The third tee connector 143 is further defined with a seventh port 257, an eighth port 258, and a ninth port 259. The fourth tee connector 144 is further defined with a tenth port 260, an eleventh port 261, and a twelfth port 262.

The base structure 102 further comprises a first 90 degree elbow tee 145 and a second 90 degree elbow tee 146. The first 90 degree elbow tee 145 is a commercially available 90 degree elbow tee connector 404. The second 90 degree elbow tee 146 is a commercially available 90 degree elbow tee connector 404. The first 90 degree elbow tee 145 is further defined with a thirteenth port 263, a fourteenth port 264, and a fifteenth port 265. The second 90 degree elbow tee 146 is further defined with a sixteenth port 266, a seventeenth port 267, and a eighteenth port 268.

The base structure 102 further comprises a first 90 degree cross tee 147 and a second 90 degree cross tee 148. The first 90 degree cross tee 147 is a commercially available 90 degree elbow cross tee connector 405. The second 90 degree cross tee 148 is a commercially available 90 degree elbow cross tee connector 405. The first 90 degree cross tee 147 is further defined with a nineteenth port 269, a twentieth port 270, a twenty first port 271, and a twenty second port 272. The second 90 degree cross tee 148 is further defined with a twenty third port 273, a twenty fourth port 274, a twenty fifth port 275, and a twenty sixth port 276.

The base structure 102 further comprises a first 90 degree elbow 149 and a second 90 degree elbow 150. The first 90 degree elbow 149 is a commercially available 90 degree elbow 401. The second 90 degree elbow 150 is a commercially available 90 degree elbow 401. The first 90 degree elbow 149 is further defined with a twenty seventh port 277 and a twenty eighth port 278. The second 90 degree elbow 150 is further defined with a twenty ninth port 279 and a thirtieth port 280.

The rail 103 is a handle that is attached to the base structure 102. The rail 103 provides a grip that allows for the movement and manipulation of the invention 100. The rail 103 further comprises a U shaped rod 151. The U shaped rod 151 is further defined with a forty third end 243 and a forty fourth end 244. The U shaped rod 151 is a commercially available hollow cylindrical pipe that is bent in the shape of a U. The U shaped rod 151 attaches to the first shaft 121 and forms a grip for the invention 100.

The seating cushion 104 further comprises a seating plate 161, a seating pad 162, and a coaxial aperture 163. The seating cushion 104 combines with the folding cushion 105 to form the horizontal surface for seating. The seating cushion 104 is a rectangular structure that is mounted on the superior surface of the base structure 102. The seating cushion 104 has a coaxial aperture 163 formed through it to allow for the passage of eliminations and excretions into the commode 302.

The seating plate 161 is a rectangular metal plate that attaches to the superior surface of the base structure 102. The seating plate 161: 1) provides the structural support for a patient sitting on the invention 100; and, 2) provides an attachment point upon which the seating pad 162 is placed. The seating pad 162 is a cushion. The padding material of the seating pad 162 is formed from a water impermeable plastic sheeting that allows the seating pad 162 to be readily cleaned. The coaxial aperture 163 refers to a rectangular aperture that is formed through the seating cushion 104 from the superior surface to the inferior surface of the seating cushion 104.

The folding cushion 105 combines with the seating cushion 104 to form the horizontal surface for seating. The folding cushion 105 is a rectangular structure that is mounted on the superior surface of the base structure 102 adjacent to the seating cushion 104. The folding cushion 105 rotates around a hinge 173 towards and away from the seating cushion 104. When the folding cushion 105 is rotated to a position that is perpendicular to the superior surface of the seating cushion 104, the folding cushion 105 forms a barrier that prevents a patient from falling out of the invention 100 during normal use.

The folding cushion 105 further comprises a folding plate 171, a folding pad 172, a hinge 173, a first support 174, and a second support 175. The first support 174 is further defined with a forty fifth end 245 and a forty sixth end 246. The second support 175 is further defined with a forty seventh end 247 and a forty eighth end 248.

The folding plate 171 is a rectangular metal plate that attaches to the superior surface of the base structure 102. The folding plate 171: 1) provides the structural support for a patient sitting on the invention 100; and, 2) provides an attachment point upon which the folding pad 172 is placed. The folding pad 172 is a cushion. The padding material of the folding pad 172 is formed from a water impermeable plastic sheeting that allows the folding pad 172 to be readily cleaned. The hinge 173 is a commercially available hinge that attaches the folding cushion 105 to the eighth shaft 128. The first support 174 is a commercially available device that supports the folding cushion 105 in a position that is perpendicular to the superior surface of the seating cushion 104. The second support 175 is a commercially available device that supports the folding cushion 105 in a position that is perpendicular to the superior surface of the seating cushion 104.

The back rest 106 is a perpendicular structure that forms the superior structure of the invention 100. The back rest 106 is a vertical cushion that supports the back of the patient. The back rest 106 further comprises a backrest cushion 181 and a backrest plate 182. The backrest cushion 181 is a rectangular cushion that is attached to the backrest plate 182. The backrest plate 182 is a rectangular metal plate that attaches to the superior surface of the eleventh shaft 131 and the thirteenth shaft 133 to form a surface that is perpendicular to the superior surface of the seating cushion 104.

The assembly of the invention 100 is described in the following 11 paragraphs.

The first tee connector 141 attaches the second shaft 122 to the tenth shaft 130 and the third shaft 123. The second tee connector 142 attaches the third shaft 123 to the twelfth shaft 132 and the fourth shaft 124. The third tee connector 143 attaches the fourth shaft 124 to the eighth shaft 128 and the fifth shaft 125. The fourth tee connector 144 attaches the seventh shaft 127 to the eighth shaft 128 and the ninth shaft 129.

The first 90 degree elbow tee 145 attaches the fifth shaft 125 to the fourth arm 194 and the sixth shaft 126. The second 90 degree elbow tee 146 attaches the sixth shaft 126 to the sixth arm 196 and the seventh shaft 127. The first 90 degree cross tee 147 attaches the first shaft 121 to the second arm 192, the U shaped rod 151 and the second shaft 122. The second 90 degree cross tee 148 attaches the ninth shaft 129 to the eighth arm 198, the U shaped rod 151, and the first shaft 121. The first 90 degree elbow 149 attaches the thirty sixth end 236 of the tenth shaft 130 to the thirty seventh end 237 of the eleventh shaft 131. The second 90 degree elbow 150 attaches the fortieth end 240 of the eleventh shaft 131 to the forty first end 241 of the thirteenth shaft 133.

The third end 203 of the second arm 192 inserts into the second end 202 of the first arm 191. The fifth end 205 of the fourth arm 194 inserts into the fourth end 204 of the third arm 193. The seventh end 207 of the sixth arm 196 inserts into the sixth end 206 of the fifth arm 195. The ninth end 209 of the eighth arm 198 inserts into the seventh end 207 of the seventh arm 197.

The twentieth end 220 of the first shaft 121 inserts into the first port 251 of the first tee connector 141. The thirty fifth end 235 of the thirtieth end 230 inserts into the second port 252 of the first tee connector 141. The twenty first end 221 of the third shaft 123 inserts into the third port 253 of the first tee connector 141. The twenty second end 222 of the third shaft 123 inserts into the fourth port 254 of the second tee connector 142. The thirty ninth end 239 of the twelfth shaft 132 inserts into the fifth port 255 of the second tee connector 142. The twenty third end 223 of the fourth shaft 124 inserts into the sixth port 256 of the second tee connector 142. The twenty fourth end 224 of the fourth shaft 124 inserts into the seventh port 257 of the third tee connector 143.

The thirty first end 231 of the eighth shaft 128 inserts into the eighth port 258 of the third tee connector 143. The twenty fifth end 225 of the fifth shaft 125 inserts into the ninth port 259 of the third tee connector 143. The thirtieth end 230 of the seventh shaft 127 inserts into the tenth port 260 of the fourth tee connector 144. The thirty second end 232 of the eighth shaft 128 inserts into the eleventh port 261 of the fourth tee connector 144. The thirty third end 233 of the ninth shaft 129 inserts into the twelfth port 262 of the fourth tee connector 144. The twenty sixth end 226 of the fifth shaft 125 inserts into the thirteenth port 263 of the first 90 degree elbow tee 145. The eighth end 208 of the fourth arm 194 inserts into the fourteenth port 264 of the first 90 degree elbow tee 145.

The twenty eighth end 228 of the sixth shaft 126 inserts into the fifteenth port 265 of the first 90 degree elbow tee 145. The twenty eighth end 228 of the sixth shaft 126 inserts into the sixteenth port 266 of the second 90 degree elbow tee 146. The twelfth end 212 of the sixth arm 196 inserts into the seventeenth port 267 of the second 90 degree elbow tee 146. The twenty ninth end 229 of the seventh shaft 127 inserts into the eighteenth port 268 of the second 90 degree elbow tee 146. The eighteenth end 218 of the first shaft 121 inserts into the nineteenth port 269 of the first 90 degree cross tee 147. The forty third end 243 of the U shaped rod 151 inserts into the twentieth port 270 of the first 90 degree cross tee 147.

The fourth end 204 of the second arm 192 inserts into the twenty first port 271 of the first 90 degree cross tee 147. The nineteenth end 219 of the second shaft 122 inserts into the twenty second port 272 of the first 90 degree cross tee 147. The thirty fourth end 234 of the ninth shaft 129 inserts into the twenty third port 273 of the second 90 degree cross tee 148. The forty fourth end 244 of the U shaped rod 151 inserts into the twenty fourth port 274 of the second 90 degree cross tee 148. The sixteenth end 216 of the eighth arm 198 inserts into the twenty fifth port 275 of the second 90 degree cross tee 148. The seventeenth end 217 of the first shaft 121 inserts into the twenty sixth port 276 of the second 90 degree cross tee 148.

The thirty sixth end 236 of the tenth shaft 130 inserts into the twenty seventh port 277 of the first 90 degree elbow 149. The thirty seventh end 237 of the eleventh shaft 131 inserts into the twenty eighth port 278 of the first 90 degree elbow 149. The fortieth end 240 of the twelfth shaft 132 inserts into the twenty ninth port 279 of the second 90 degree elbow 150. The forty first end 241 of the thirteenth shaft 133 inserts into the thirtieth port 280 of the second 90 degree elbow 150.

The backrest plate 182 of the back rest 106 attaches to the thirty eighth end 238 of the eleventh shaft 131 and the forty second end 242 of the thirteenth shaft 133. The seating cushion 104 attaches to and rests upon the first shaft 121, the second shaft 122, the third shaft 123, the eighth shaft 128, and the ninth shaft 129. The folding cushion 105 rests upon the fifth shaft 125, the sixth shaft 126, the seventh shaft 127, and the eighth shaft 128.

The forty fifth end 245 of the first support 174 attaches to the folding plate 171 of the folding cushion 105. The forty seventh end 247 of the second support 175 attaches to the folding plate 171 of the folding cushion 105. The forty sixth end 246 of the first support 174 attaches to the fifth shaft 125. The forty eighth end 248 of the second support 175 attaches to the seventh shaft 127. The first support 174 attaches the face of the fifth shaft 125 to the folding plate 171. The second support 175 attaches the face of the seventh shaft 127 to the folding plate 171.

The outer diameter of the twenty fifth end 225 of the fifth shaft 125 is sized such that it can be inserted through the third tee connector 143 into the twenty fourth end 224 of the fourth shaft 124 in a telescopic manner that further allows for the adjustment of the width of the seating accommodations provided by the base structure 102. The outer diameter of the thirtieth end 230 of the seventh shaft 127 is sized such that it can be inserted through the fourth tee connector 144 into the thirty third end 233 of the ninth shaft 129 in a telescopic manner that further allows for the adjustment of the width of the seating accommodations provided by the base structure 102.

The following definitions were used in this disclosure:

90 Degree Elbow: As used in this disclosure, a 90 degree elbow is a two aperture pipe fitting that attaches a first pipe to a second pipe such that the center axis of the first pipe is perpendicular to the center axis of the second pipe. The 90 degree elbow is a commercially available plumbing and PVC pipe fitting.

90 Degree Elbow Tee Connector: As used in this disclosure, a 90 degree elbow tee connector is a three aperture pipe fitting that attaches a first pipe, a second pipe, and a third pipe such that: 1) the center axis of the first pipe is perpendicular to the center axis of the second pipe; 2) the center axis of the second pipe is perpendicular to the center axis of the third pipe; 3) the center axis of the third pipe is perpendicular to the center axis of the first pipe; and, 4) the center axes of the first pipe, the second pipe and the third pipe intersect at the same point. The 90 degree elbow tee is a commercially available plumbing and PVC pipe fitting.

90 Degree Elbow Cross Tee Connector: As used in this disclosure, a 90 degree elbow cross tee connector is a four aperture pipe fitting that attaches a first pipe, a second pipe, a third pipe, and a fourth pipe such that: 1) the center axis of the first pipe is aligned with the center axis of the second pipe; 2) the center axis of the third pipe is perpendicular to the aligned center axes of the first pipe and the second pipe; 3) the center axis of the fourth pipe is perpendicular to the center axis of the third pipe; 4) the center axis of the fourth pipe is perpendicular to the aligned center axes of the first pipe and the second pipe; and, 5) the center axes of the) the center axes of the first pipe, the second pipe, the third pipe, and the fourth pipe intersect at the same point. The 90 degree elbow cross tee connector is a commercially available plumbing and PVC pipe fitting.

Align: As used in this disclosure, align refers to an arrangement of objects that are: 1) arranged in a straight line; or, 2) arranged to give a directional sense of a plurality of parallel lines.

Coaxial: As used in this disclosure, coaxial is an term that refers to a first object that is inserted or contained within a second object such: 1) that the first object and the second object share the same center point if the or first object and the second object are treated as a two dimensional objects; or, 2) that the first object and the second object share the same center axis if the or first object and the second object are treated as a similar prisms.

Cross Tee Connector: As used in this disclosure, a cross tee connector is a four aperture pipe fitting that attaches a first pipe, a second pipe, a third pipe, and a fourth pipe such that: 1) the center axis of the first pipe is aligned with the center axis of the second pipe; 2) the center axis of the third pipe is aligned with the center axis of the fourth pipe; 3) the aligned center axes of the first pipe and the second pipe are perpendicular to the aligned center axes of the third pipe and the fourth pipe; and, 4) the center axes of the first pipe, the second pipe, the third pipe, and the fourth pipe intersect at the same point. The cross tee connector is a commercially available plumbing and PVC pipe fitting.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or cone like structure. When the center axes of two cylinder or like structures share the same line they are said to be aligned. When the center axes of two cylinder like structures do not share the same line they are said to be offset.

Cushion: As used in this disclosure a cushion is a structure formed from a pad that is used to prevent injury or damage to a person or object.

Force Of Gravity: As used in this disclosure, the force of gravity refers to a vector that indicates the direction of the pull of gravity on an object at or near the surface of the earth.

Hinge: As used in this disclosure, a hinge is a device that permits the turning, rotating, or pivoting of a first object relative to a second object.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity.

Negative Space: As used in this disclosure, negative space is a method of defining an object through the use of open or empty space as the definition of the object itself, or, through the use of open or empty space to describe the boundaries of an object.

Pad: As used in this disclosure, a pad is a mass of soft material used as a filling or for protection against damage or injury. Commonly used padding materials include, but are not limited to, polyurethane foam, a polyester fill often referred to as fiberfill or polystyrene beads often referred to as stuffing beans or as bean bag chair beans.

Patient: As used in this disclosure, a patient is a person who is designated to receive a medical treatment, therapy or service. The term patient may be extended to an animal when used within the context of the animal receiving veterinary treatment or services Pivot: As used in this disclosure, a pivot is a rod or shaft around which an object rotates or swings.

Plate: As used in this disclosure, a plate is a smooth, flat and semi-rigid or rigid structure that has at least one dimension that: 1) is of uniform thickness; and 2) that appears thin relative to the other dimensions of the object. Plates often have a rectangular or disk like appearance. As defined in this disclosure, plates may be made of any material, but are commonly made of metal. When made of wood, a plate is often referred to as a board.

Prism: As used in this disclosure, a prism is a 3 dimensional geometric structure wherein: 1) the form factor of two faces of the prism correspond to each other; and, 2) the two corresponding faces are parallel to each other. In this disclosure, when further description is required a prism will be named for the geometric or descriptive name of the form factor of the two corresponding faces. If the form factor of the two corresponding faces has no clearly established or well-known geometric or descriptive name, the term irregular prism will be used. The center axis of a prism is defined as a line that joins the center point of the first corresponding face of the prism to the center point of the second corresponding face of the prism. The center axis of a prism is otherwise analogous the center axis of a cylinder.

Superior: As used in this disclosure, the term superior refers to a directional reference that is parallel to and in the opposite direction of the force of gravity.

Supporting Surface: As used in this disclosure, a supporting surface is a horizontal surface upon which an object is placed. Within this disclosure, it is assumed that the object is placed on the supporting surface in an orientation that is appropriate for the normal or anticipated use of the object.

Tee Connector: As used in this disclosure, a T Connector is a three aperture fitting that is designed to connect a first pipe, a second pipe and a third pipe such that: 1) the center axis of the first pipe is aligned with the center axis of the second pipe; 2) the center axis of the third pipe is perpendicular to the aligned center axes of the first pipe and the second pipe; and, 3) the center axes of the first pipe, the second pipe, and the third pipe intersect at a single point. The tee connector is a commercially available plumbing and PVC pipe fitting.

Telescopic: As used in this disclosure, telescopic is an adjective that describes an object made of sections that fit or slide into each other such that the object can be made longer or shorter by adjusting the relative positions of the sections.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Wheel: As used in this disclosure, a wheel is a circular object that revolves around an axle or an axis and is fixed below an object to enable it to move easily over the ground.

With respect to the above description, it is to be realized that the optimum dimensional relationship for the various components of the invention described above and in FIGS. 1 through 11 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A multi-purpose sanitary chair for use as a raised toilet seat and a bathing chair and transfer bench, comprising:

a frame having four corners and a plurality of sides;

a handle extending upwardly from one side of the frame, the handle having a length parallel to the one side;

a seat disposed on the frame along the one side;

an opening in the seat;

a panel being disposed on the frame adjacent to the seat and opposite the one side;

a backrest extending upwardly from a second side of the frame, wherein the backrest is substantially normal to the handle;

four legs, each one of the legs supporting a corresponding corner of the frame; and a pair of wheels, each one of the wheels supporting one of the legs disposed opposite the one side such that the chair can be rolled during transport, wherein the panel is hingedly rotatable about an axis proximate the seat between a horizontal position and an upright position, and wherein the panel rotates independently of the four legs such that the four legs remain fixed during use of the chair.

2. The multi-purpose sanitary chair of claim 1, wherein the frame has a width, and the width of the frame is adjustable.

3. The multi-purpose sanitary chair of claim 1, wherein the legs have a length, and the length of the legs is adjustable.

4. The multi-purpose sanitary chair of claim 1, wherein the backrest is removable.

5. The multi-purpose sanitary chair of claim 1, wherein the backrest is switchable from the second side to the opposite side.

6. The multi-purpose sanitary chair of claim 1, wherein the handle has a height and the panel has a width, and the height of the handle is substantially equal to the width of the panel.

7. The multi-purpose sanitary chair of claim 1, wherein the panel releasably locks into the upright position.

8. A multi-purpose sanitary chair for use as a raised toilet seat and a bathing chair and transfer bench, comprising:

a frame having four corners and a plurality of sides;

a handle extending upwardly from one side of the frame, the handle having a length parallel to the one side and a height;

a seat disposed on the frame along the one side;

an opening in the seat, the opening being of sufficient size for use with a toilet;

a panel having a width and being disposed on the frame adjacent to the seat and opposite the one side;

a backrest extending upwardly from a second side of the frame, wherein the backrest is substantially normal to the handle;

exactly four legs, each one of the legs supporting a corresponding corner of the frame; and a pair of casters, each one of the casters supporting one of the legs disposed opposite the one side such that chair can be rolled during transport;

wherein the panel is hingedly rotatable about an axis proximate the seat between a horizontal position and an upright position, and wherein the panel rotates independently of the four legs such that the tour legs remain fixed during use of the chair, and wherein the height of the handle is equal to the width of the panel.

* * * * *